United States Patent [19]

Klocke

[11] 4,321,722

[45] Mar. 30, 1982

[54] BURNISHING BRUSH STRUCTURE

[76] Inventor: Richard R. Klocke, Rte. 1, Box 3, Lindsborg, Kans. 67457

[21] Appl. No.: 109,227

[22] Filed: Jan. 3, 1980

[51] Int. Cl.[3] ..... A46B 13/06

[52] U.S. Cl. ..... 15/29; 51/170 T; 173/169

[58] Field of Search ..... 15/24, 29, 97 R; 51/170 T, 171; 433/82, 84, 85, 132; 29/89.5, 90.1; 173/168, 169, 170

[56] References Cited

U.S. PATENT DOCUMENTS

| | | | |
|---|---|---|---|
| 963,477 | 7/1910 | Service et al. | 15/29 |
| 1,247,484 | 11/1917 | Albrecht, Jr. | 15/24 |
| 1,625,792 | 4/1927 | Carrington | 15/29 |
| 1,679,323 | 7/1928 | Mortlock | 15/29 |
| 1,698,970 | 1/1929 | Shaff | 51/170 T |
| 1,808,656 | 6/1931 | Hartman | 15/29 X |
| 1,881,129 | 10/1932 | Peek et al. | 15/29 |
| 3,943,591 | 3/1976 | Lanusse | 15/29 |
| 4,208,753 | 6/1980 | Lewis | 15/29 |

FOREIGN PATENT DOCUMENTS

| | | | |
|---|---|---|---|
| 300709 | 11/1928 | United Kingdom | 15/29 |

*Primary Examiner*—Edward L. Roberts
*Attorney, Agent, or Firm*—Phillip A. Rein

[57] ABSTRACT

This invention is a burnishing brush structure operable to supply material such as paint pigments to a paper surface at the center of a rotating brush member which forces the pigments into the paper to achieve an artistic result. The burnishing brush structure includes (1) a main housing assembly to be held in a person's hand; (2) a power drive assembly to drive the rotating brush member; (3) a pigment brush and container assembly to supply the rotating brush member with material to be burnished; and (4) a power supply and actuator control assembly to (a) control rotating speed of the brush member; and (b) control supply of the material to the rotating brush member.

6 Claims, 4 Drawing Figures

BURNISHING BRUSH STRUCTURE

PRIOR ART

The end result achieved herein by this invention of burnishing a material such as paint pigment into a paper material has been done by a hand polishing operation. A search revealed no structure achieving the applicant's end result. The prior art references found were U.S. Pat. Nos. 1,166,482, 1,698,970, 1,706,402, 1,783,960, 2,400,912, 4,025,666.

The Pierce patent teaches the means of applying pigment to a paper surface by hand.

The other patents teach the supplying of a fluid to the center of a rotating brush but are not operable in a manner claimed herein.

PREFERRED EMBODIMENT OF THE INVENTION

In one preferred embodiment of the invention, a burnishing brush structure includes (1) a main housing assembly to be held in one's hand; (2) a power drive assembly extended the length and extended outwardly of the main housing assembly to support a brush member therein; (3) a pigment brush and container assembly having a container member to carry material therein to be selectively dispensed to the rotating brush member; and (4) a power supply and actuator control assembly to control operation of the power drive assembly to rotate the brush material and dispensing of the material to the brush member. The main housing assembly is of light weight and preferably supplied with compressed air as a power source. The power supply and actuator control assembly includes a pair of adjacent actuator members being controlled by a person's forefinger and adjacent finger whereby the actuator members are selectively depressed to (1) rotate the brush material; and (2) dispense material to the brush member.

OBJECTS OF THE INVENTION

One object of this invention is to provide a burnishing brush structure that is lightweight, easily held in a persons's hand, and operable to dispense a material onto a support surface.

Another object of this invention is to provide a burnishing brush structure operable with a supply of compressed air to (1) rotate a brush member at desired speed; and (2) dispense a selected amount of material to the center of the rotating brush member.

Still another object of this invention is to provide a burnishing brush structure having material container members that can be easily removed and replaced with another container member to achieve immediate changes in use of color pigments.

Still one further object of this invention is to provide a burnishing brush structure that is easy to use, economical to manufacture, is valuable in operation, and substantially maintenance free.

Various other objects, advantages, and features of the invention will become apparent to those skilled in the art from the following discussion, taken in conjunction with the accompanying drawings, in which:

FIGURES OF THE INVENTION

Figure 1:
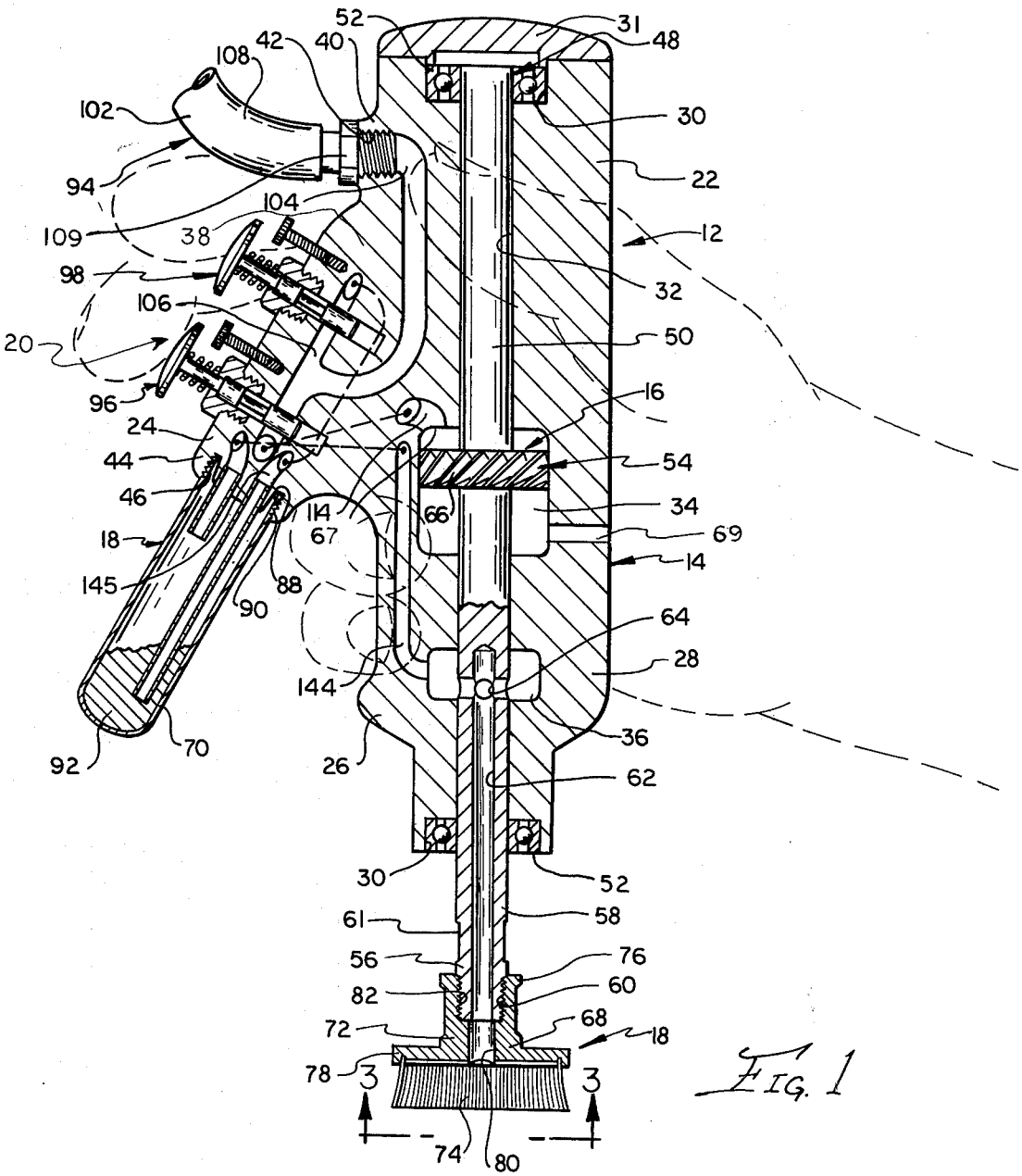
FIG. 1 is an elongated vertical sectional view of the burnishing brush structure of this invention.

The following is a discussion and description of preferred specific embodiments of the new burnishing brush structure of this invention, such being made with reference to the drawings, whereupon the same reference numerals are used to indicate the same or similar parts and/or structure. It is to be understood that such discussion and description is not to unduly limit the scope of the invention.

DESCRIPTION OF THE INVENTION

Referring to the drawings in detail and in particular to FIG. 1, the burnishing brush structure of this invention, indicated generally as 12, includes (1) a main housing assembly 14; (2) a power drive assembly 16 mounted in the main housing assembly 14; (3) a brush and container assembly 18 connected to the main housing assembly 14 and the power drive assembly 16; and (4) a power supply and actuator control assembly 20 mounted in the main housing assembly 14 to control operation thereof as will be explained. The main housing assembly 14 includes a hand housing member 22 integral with a control housing member 24.

The hand housing member 14 is generally cylindrical in shape with a lower ridge section 26 to receive a portion of one's hand thereagainst. The hand housing member 14 includes a main body member 28 with upper and lower bearing member openings 30, a cap member 31 to enclose the upper bearing member opening 30, a central, elongated shaft hole 32 extended the length of the main body member 28, a circular power motor opening 34 located generally, centrally of the main body member 28, and a lower material discharge opening 36.

As noted in FIG. 1, the control housing member 24 includes a laterally projecting housing section 38. The housing section 38 includes (1) an upper housing portion 40 with a female threaded opening 42 to receive a power supply; and (2) a lower housing section 44 with a lower female threaded opening 46 to receive a container member thereon as will be explained.

The power drive assembly 16 includes a main driven shaft assembly 48 mounted in the central, elongated shaft hole 32 in the main body member 28. The main driven shaft assembly 48 includes (1) an elongated shaft member 50 supported at opposite ends by bearing members 52 mounted in respective bearing member openings 30; (2) a motor assembly 54 mounted in the power motor opening 34; and (3) a connector end section 56 on a lower end portion 58 of the shaft member 50 having male threads 60 thereon and a connector portion 61 to be grasped by a crescent wrench or the like.

The shaft member 50 has a central dispensing hole 62 extended from the material discharge opening 36 through the connector end section 56. An upper end of the central dispensing hole 62 includes spaced material receiving holes 64, namely four, into the material discharge opening 36, for reasons to become obvious.

The motor assembly 54 is of a conventional air driven type power means having a blade assembly 66 secured to the shaft member 50 in the power motor opening 34. An opening 67 in the power motor opening 34 directs a pressurized flow into the blade assembly 66 to rotate same and interconnected shaft member 50 at a selected, desired speed. A discharge opening indicated at 69 is provided on the bottom side of the blade assembly 66 for operation thereof in a conventional air motor manner.

The brush and container assembly 18 includes a brush member 68 connected to the shaft member 50 and a material container assembly 70 connected to the threaded opening 46 in the lower housing section 44.

The brush member 68 includes a support body 72 with brush bristol members 74 connected thereto. The support body 72 includes an upper connector section 76 integral with a brush support section 78 and a central discharge opening 80 extended the length thereof. The connector section 76 is provided with female threads 82 to be connected to the male threads 60 on the shaft member 50 (FIG. 1).

Figure 3:
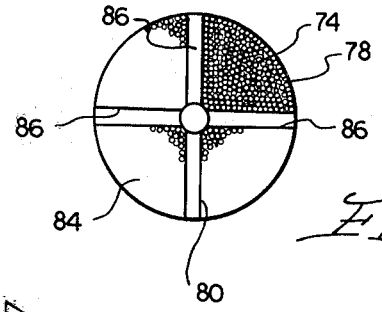
FIG. 3 is a sectional view taken along line 3—3 in FIG. 1.

As best shown in FIG. 3, a bottom surface 84 of the brush support section 78 is provided with four spaced grooves 86 to direct material outwardly for burnishing into the support surface by the brush bristol members 74. It is understood that the brush member 68 can be made of various materials, sizes, brush material, etc., depending on desired end result.

The material container assembly 70 resembles a test tube with an open upper end section 88 provided with male threads 90 to connect to the threaded opening 46. Several material container assemblies 70 may be provided so that a quick, easy change thereof can be achieved. A material, indicated at 92, is placed in the material container assembly 70 in a manner to be explained.

The power supply and actuator control assembly 20 includes (1) an inlet supply channel assembly 94; (2) a motor supply and control assembly 96; and (3) a material dispensing and control assembly 98.

The inlet supply channel assembly 94 includes (1) a supply hose member 102; (2) a supply channel 104; and (3) a distribution channel 106. The supply hose member 102 includes a hose member 108 connected to a connector member 109, which, in turn, is mounted in the threaded opening 42 of the upper housing portion 40. The hose member 108 conveys an air supply at desired volume and pressure to the supply channel 104.

The supply channel 104 then conveys the air supply to the distribution channel 106.

Figure 2:
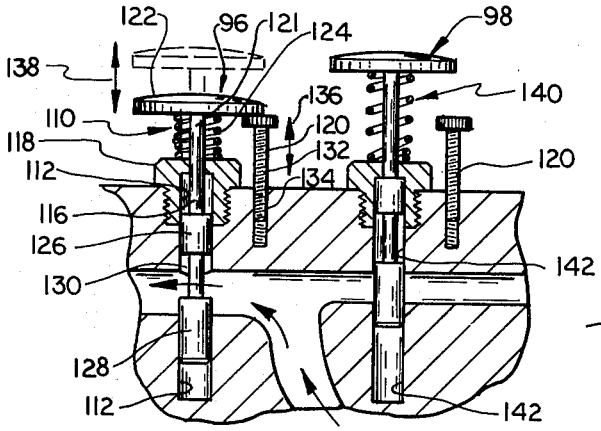
FIG. 2 is an enlarged fragmentary sectional view of a power supply and actuator control assembly of the burnishing brush structure of this invention.

As shown in FIG. 2, the motor supply and control assembly 96 includes an actuator assembly 110 mounted in an actuator channel 112 which connects to a motor supply channel 114.

The actuator assembly 110 includes an actuator member 116 mounted in a support bushing 118 and a stop member 120 to limit movement of the actuator member 116.

The actuator member 116 includes (1) a control shaft 121; (2) an actuator cap 122 secured to an upper end of the control shaft 121; and (3) a spring member 124 mounted between the actuator cap 122 and the support bushing 118 to bias the actuator member 116 to the closed, inactive position as will become obvious.

The control shaft 121 includes an upper plunger section 126 and a lower plunger section 128, each moves in a sealed manner in the actuator channel 112. The control shaft 121 is movable axially to allow an air supply to move between the plunger section 126, 128 at a central portion 130 to the motor supply channel 114.

The support bushing 118 holds the actuator member 116 in the actuator channel 112 which is obvious.

The stop member 120 is a bolt member 132 mounted in a threaded opening 134 for movement as shown by an arrow 136 (FIG. 2). This adjusts and controls movement of the actuator member 116 as shown by an arrow 138 in FIG. 2.

The material dispensing and control assembly 98 is substantially identical to the above described motor supply and control assembly 96 including a material actuator assembly 140 mounted in an air supply channel 142 which, in turn, is connected to a material supply channel 144 to the material discharge opening 36 and to a container supply channel 145.

The material actuator assembly 140 contains the previously described elements as so interconnected being an actuator member 116 mounted in a support bushing 118 and a stop member 120 mounted adjacent the actuator member 116. The actuator member 116 used herein is the same as previously described except directs air pressure from the air supply channel 142 and the distribution channel 106 into the container supply channel 145 to the material container assembly 70, picks up material 92 therein, and conveys tha air and material mixture into the material supply channel 144 and the lower material discharge opening 36.

USE AND OPERATION OF THE INVENTION

In the use and operation of the burnishing brush structure 12, the hand housing member 14 is grasped by a person's hand as shown in dotted lines in FIG. 1. An upper end of the control housing member 24 has the hose member 102 and the connector member 109 mounted in the threaded opening 42. An air supply is provided in the hose member 108 to supply air to the supply channel 104.

Next, the material container assembly 70 is filled with the desired material, normally a paint pigment. This is connected to the threaded opening 46 in the control housing member 24 in an air-tight manner.

Then, a desired brush member 68, such as shown in FIGS. 1 and 3, is connected to male threads 60 of the connector end assembly 56 of the main driven shaft assembly 48.

Figure 4:
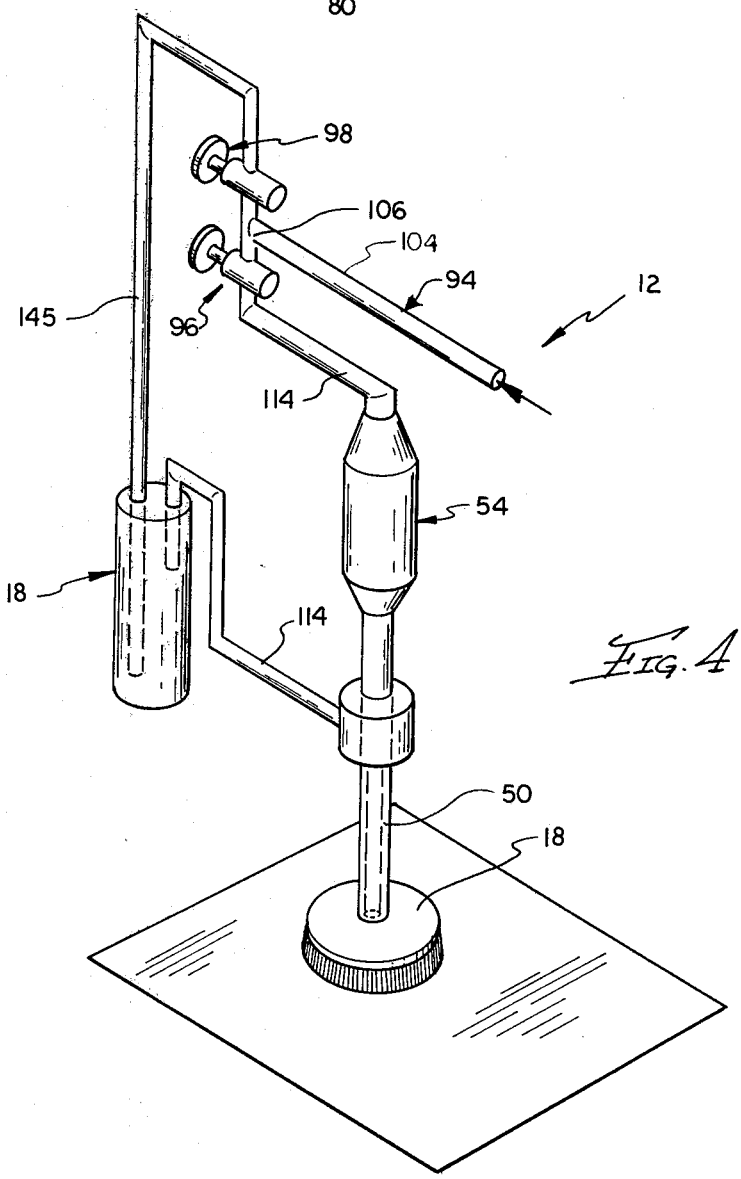
FIG. 4 is a schematic diagram of the use and operation of the burnishing brush structure of this invention.

As shown in schematic in FIG. 4, the burnishing brush structure 12 is placed over a piece of cloth or paper to receive the material such as paint pigment thereon. The inlet pressurized air is supplied to the supply channel 104 which connects to the distribution channel 106. Air is released therefrom by selective or joint operation of (1) the motor supply and control assembly 96; and/or (2) the material dispensing assembly 98.

With the motor supply and control assembly 96, the actuator member 116 is depressed, as shown in dotted lines in FIG. 2, the control shaft 121 moves axially to allow the air supply to move about the central portion 130 to the motor supply channel 114. The motor assembly 54 then rotates as a conventional air driven motor to rotate the entire main driven shaft assembly 48. The speed thereof can be controlled by depression of the actuator member 116 with the stop member 120 being adjustable to achieve a positive controlled speed if so desired.

This causes the brush member 68 to rotate with the brush bristol members 74 burnishing the support paper surface.

Next, the material dispensing and control assembly 98 is operable by depression of the actuator member 116 to direct an air supply from the distribution channel 106 to the container supply channel 145 and, then, through the material supply channel 144 from the material container assembly 70. The pigment therein is picked up by the air flow and conveyed to the material discharge opening 36 from the container supply channel 145.

The pigment material is carried from the material discharge opening 36 to the central dispensing hole 62 to the brush member 68. The pigment material then flows outwardly in the grooves 86 on the support surface to be burnished thereon.

The supply of pigment material is controlled by depression of the actuator member 116 with movement thereof being controlled by the adjustable stop member 120.

The burnishing brush structure is lightweight, easy to use, readily controllable, as to speed and material dispensing, and attractive in appearance.

While the invention has been described in conjunction with preferred specific embodiments thereof, it will be understood that this description is intended to illustrate and not to limit the scope of the invention, which is defined by the following claims.

I claim:

1. A burnishing brush structure operable to burnish a material into a support surface, comprising:

(a) a main housing assembly operable to be held, grasped, and maneuvered in a person's single hand;

(b) a power drive assembly mounted in said main housing assembly having a rotatable shaft member;

(c) a brush and container assembly having a brush member connected to an outer end of said shaft member for rotation thereof and a material container assembly connected to said main housing assembly;

(d) a power supply and actuator control assembly mounted in said main housing assembly and connected to said shaft member and said material container assembly;

(e) said power supply and actuator control assembly includes a motor supply and control assembly and a material dispensing and control assembly mounted in said main housing assembly;

(f) said motor supply and control assembly and said material dispensing and control assembly each having an actuator member mounted adjacent each other so as to be actuated by adjacent fingers on the person's single hand; and (g) said actuator members being respectively and selectively actuated to (1) accurately control rotational speed of said shaft member; and (2) precisely control the amount of material dispensed to said brush member.

2. A burnishing brush structure as described in claim 1, wherein:

(a) each of said actuator members having an actuator cap secured to a control shaft; and (b) said actuator caps being depressed to move said control shafts to selectively and respectfully control rotational speed of said shaft member and the amount of material dispensed to said brush member.

3. A burnishing brush structure as described in claim 1, wherein;

(a) said material dispensing and control assembly includes an adjustable control member mounted adjacent said actuator member to control movement thereof and the amount of material dispensed to said brush member.

4. A burnishing brush structure as described in claim 1, wherein;

(a) said motor supply and control assembly includes an adjustable control member mounted adjacent said actuator member to control movement thereof and the rotational speed of said shaft member.

5. A burnishing brush structure operable to burnish a material into a support surface, comprising:

(a) a main housing assembly adapted to be held in one's hand;

(b) an air powered drive assembly mounted in said main housing assembly having a rotatable shaft member;

(c) an air pressure supply means for said drive assembly;

(d) a brush and container assembly having a brush member connected to an outer end of said shaft member for rotation thereof and a material container assembly connected to said main housing assembly;

(e) a power supply and actuator control assembly mounted in said main housing assembly and connected to said shaft member and said material container assembly and operable to dispense the material to said brush member;

(f) said power supply and actuator control assembly includes an actuator member to be depressed by one's finger to permit a selected amount of the air pressure to control rotational speed of said brush member; and (g) said power supply and actuator control assembly includes an adjustable stop member to control and adjust amount of depression of said actuator member.

6. A burnishing brush structure as described in claim 5, wherein:

(a) said power supply and actuator control assembly includes a material actuator assembly having a material actuator member;

(b) said material actuator member to be depressed by one's fingers to permit a selected amount of the air pressure to flow into said material container assembly, pick up some material therein, and convey the material to said brush member; and (c) said material actuator assembly includes an adjustable stop member to control and adjust the amount of depression of said material actuator member.

* * * * *